US005863490A

United States Patent [19]

Yamada

[11] Patent Number: 5,863,490

[45] Date of Patent: Jan. 26, 1999

[54] GAS BLAST NOZZLE FOR MOLTEN METAL AND METHOD OF USING THE SAME

[75] Inventor: Hiroshi Yamada, Fukuoka, Japan

[73] Assignee: Japan Casting & Forging Corporation, Tokyo, Japan

[21] Appl. No.: 788,986

[22] Filed: Jan. 24, 1997

[30] Foreign Application Priority Data

| | | | |
|---|---|---|---|
| May 25, 1995 | [JP] | Japan | 7-126107 |
| Dec. 13, 1995 | [JP] | Japan | 7-324447 |
| May 23, 1996 | [WO] | WIPO | PCT/JP96/01356 |

[51] Int. Cl.[6] ..... C21B 7/16

[52] U.S. Cl. ..... 266/47; 266/217; 266/265; 266/DIG. 1

[58] Field of Search ..... 266/217, 220, 266/265, 45, 44, DIG. 1, 47

[56] References Cited

U.S. PATENT DOCUMENTS 5,371,759 12/1994 Wells et al. ..... 266/265

FOREIGN PATENT DOCUMENTS

| | | |
|---|---|---|
| 58-81937 | 5/1983 | Japan . |
| 59-52216 | 12/1984 | Japan . |
| 4-97835 | 8/1992 | Japan . |
| 4-61046 | 9/1992 | Japan . |
| 6-30834 | 8/1994 | Japan . |

*Primary Examiner*—Scott Kastler

*Attorney, Agent, or Firm*—Cushman Darby & Cushman IP Group of Pillsbury Madison & Sutro

[57] ABSTRACT

A gas blast nozzle for a furnace for processing molten metal has a prolonged service life and is free from gas leakage. The nozzle comprises a refractory block having a narrow straight bore and a small metal pipe slidably arranged in the straight bore. A gas is blown by the small metal pipe. When the gas blast nozzle is partially worn, the small metal pipe is moved upwardly to project into the furnace and the worn area is filled with a refractory material.

13 Claims, 4 Drawing Sheets

GAS BLAST NOZZLE FOR MOLTEN METAL AND METHOD OF USING THE SAME

This is a Continuation of International Appln. No. PCT/JP96/01356 filed May 23, 1996 which designated the U.S.

FIELD OF THE INVENTION

This invention relates to a gas blast nozzle for molten metal in a smelting furnace, such as an electric furnace or another refining furnace. More particularly, it relates to a gas blast nozzle for molten metal that can be repaired easily and a method of using the same.

DISCUSSION OF THE PRIOR ART

FIGS. 5(*a*)–5(*d*) of the accompanying drawings illustrate examples of known gas blast nozzles. FIGS. 5(*a*), (*b*) and (*c*), respectively, show a single pipe nozzle, a double pipe nozzle and a multi-pipe nozzle, and FIG. 5(*d*) shows a porous plug. Reference numerals (10) and (11) denote a gas feed hose and a refractory material in a furnace bottom, respectively, whereas (17) and (18) denote a cooling gas feed pipe and a porous brick, respectively. A multi-pipe nozzle of FIG. 5(*c*) may be realized by embedding a plurality of small metal pipes in a refractory block. Such multi-pipe nozzles have been popularly used for electric furnaces because fine and evenly sized gas bubbles can be produced in molten metal by means of the multi-pipe nozzle.

As gas is blown into molten metal through a gas blast nozzle in a refining furnace, the inner side of the refractory material of the furnace becomes worn away in an area (8) surrounding the gas blast nozzle as shown in FIG. 2(*a*) as the molten metal in the furnace is fiercely moved by the gas in an area near the gas blast nozzle. When too much refractory material has worn away, the gas blast nozzle has to be replaced, necessitating the suspending of the operation of the furnace. Furthermore, nozzle replacement is performed in an adverse environment, and, therefore, it is not recommended to replace the gas blast nozzle frequently.

Japanese Patent Application Laid-Open Publication No. 58-81937 discloses a gas blast plug comprising a refractory nozzle block having bore therethrough and a small metal pipe placed in the bore with an annular gap between the outside of the pipe and an inner surface of the bore.

FIGS. 6(*a*) and 6(*b*) of the accompanying drawings illustrate the gas blast plug according to the above. Referring to FIG. 6(*a*), an annular gap is formed between the inner surface of the bore and outer surface of the small metal pipe (2), such that the size of the annular gap is small enough so as to not leak molten metal. In FIG. 6(*a*), a gas feed hose (not shown) is connected to the small metal pipe (2). The arrangement shown in FIG. 6(*a*) seemed to be effective for prolonging the service life of a gas blast nozzle, since the gas blast nozzle can be repaired when it is partly worn due to its usage, and can serve for a long time without replacing it.

However, the inventors of the present invention have found that when the gas blast plug according to the above is used in an electric refining furnace, the gas tends to seep into the annular gap rather than enter the molten metal, as shown in FIG. 6(*b*). When the gas is supplied through the small metal pipe (2) at a low rate from the bottom of the furnace, a large static pressure of the molten metal at the bottom of the furnace may resist the gas entering into the molten metal, and the gas is urged more easily into the annular gap than into the molten metal.

SUMMARY OF THE INVENTION

The present invention provides a gas blast nozzle that seldom needs replacement and therefore minimizes the down time of a furnace necessary for replacing the gas blast nozzle and reduces the work load of the replacing operation under adverse working conditions. Furthermore, the gas blast nozzle is free from the problem of gas leaking through the gas blast nozzle.

FIGS. 1(*a*)–1(*c*) of the accompanying drawings show a gas blast nozzle according to the invention. FIG. 1(*a*) is a longitudinal sectional view of the gas blast nozzle, and FIG. 1(*b*) is a longitudinal sectional view of the gas blast nozzle showing how it is arranged in the bottom of a furnace. FIG. 1(*c*) is a longitudinal sectional view illustrating the gas blast nozzle with a coupler for connecting it with a gas feed hose.

A gas blast nozzle according to the invention comprises a refractory block (4) having a narrow and straight bore (3) extending from the inside to the outside of a furnace. It also comprises a tubular metal fitting (22) having a radially-extending cup-shaped upper end. The cup-shaped upper end of the tubular metal fitting is provided with a hole communicating with the inside of the tubular body of the tubular metal fitting. A gas blast nozzle according to the invention further comprises a metal coupler (23) including a rubber stopper (14) and connected at the lower end with a gas hose (15). The nozzle additionally comprises a small metal pipe (2).

According to the invention, the straight bore (3) of the refractory block (4), the hole of the cup-shaped upper end of the tubular metal fitting (22), the inside of the tubular body of the tubular metal fitting (22), and the inside of the metal coupler (23) are held in communication with each other to form a through path, and the refractory block (4) is formed airtightly as an integral body with the cup-shaped end of the tubular metal fitting (22). As a result, the refractory block (4) and the tubular metal fitting (22) become integral with each other. The lower end of the tubular metal fitting (22) is connected to an upper portion of the metal coupler (23) The small metal pipe (2) is so arranged that its inner end reaches to a molten metal in the furnace and its outer end is made to penetrate through the rubber stopper (14).

FIG. 1(*c*) is a view showing the entire profile of a gas blast nozzle according to the invention. The gas (12) supplied from the gas hose (15) passes through metal coupler (23) and is blown into the furnace by way of the small metal pipe (2).

According to the invention, an annular gap is formed between the straight bore (3) and the small metal pipe (2). However, because the refractory block (4) is formed airtightly with the tubular metal fitting (22) and because the small metal pipe (2) runs through the rubber stopper (14), the gas that may flow into the annular gap, if any, cannot go any further. Thus, with a gas blast nozzle according to the invention, no gas leakage occurs.

The small metal pipe (2) passes through the rubber stopper (14) and is opened for the gas hose (15). The gap between the outer periphery of the small metal pipe (2) and the inner surface of the metal coupler (23) is sealed by the rubber stopper (14) so that all the gas (12) fed in from the gas hose (15) is blown into the small metal pipe (2).

While FIGS. 1(*a*) to 1(*c*) show a gas blast nozzle (1) having a single small metal pipe (2), a gas blast nozzle according to the invention may alternatively comprise a plurality of small metal pipes (2) in such a way that the gap between each of the small metal pipes (2) and the corresponding metal coupler (23) is filled with a rubber stopper (14) so that all the gas fed into the nozzle may be blown into the small metal pipes (2) regardless of the number of small metal pipes (2).

As shown in FIG. 1(*b*), the gas blast nozzle (1) is fitted to the tuyere-forming brick (6) at the refractory bottom (11) of the furnace and secured to the outer shell (19) of the furnace by means of a securing ring (21) and a lock member (20). The gap between the nozzle and the tuyere-forming bricks is filled with some castable refractory substance (5).

The small metal pipe (2) may be a stainless steel pipe having an inner diameter of 1 to 2 mm, although the inner diameter and the number of pipes may be selected depending on the gas flow rate. Additionally, the small metal pipe may be a single pipe or a double pipe. Note that the inner diameter of the straight bore (3) is made greater than the outer diameter of the small metal pipe (2) by 0 to 4 mm in order to allow the small metal pipe (2) to move easily through the bore (3).

FIGS. 2(*a*)–2(*b*) illustrate a method of using the gas blast nozzle (1) according to the invention. A gas blast nozzle (1) according to the invention is worn and wears away the inner refractory material during its usage to produce a worn area (8) as shown in FIG. 2(*a*). According to the invention, the worn area (8) is repaired by moving the small metal pipe (2) upwardly in the straight bore (3) until the inner end of the small metal pipe (2) projects over the unworn surface inside the furnace as shown in FIG. 2(*b*).

Then, the worn area (8) is filled with a refractory material (16) without closing the inner end of the small metal pipe (2) as shown in FIG. 2(*c*). The inner end of the small metal pipe (2) projects above the inner surface of the furnace after the worn area is filled with the refractory material (16). The inner end of the small metal pipe (2) would not be buried nor clogged because of this projection even if a furnace lining repairing apparatus, such as a sand slinger, is used to fill the worn area (8) with ordinary refractory material.

Thus, with a gas blast nozzle (1) according to the invention, the gas blast nozzle and its peripheral area can be repaired easily, if necessary, during the routine maintenance of the furnace bottom and the furnace wall, which consequently prolongs the service life of the gas blast nozzle so that the frequency of replacing the gas blast nozzle will be remarkably reduced.

When gas is blown into the molten metal in the furnace after filling the worn area as shown in FIG. 2(*c*), the projecting portion of the small metal pipe (2) is immediately melted away and the inner end of the gas blast nozzle will show a profile as shown in FIG. 1(*b*). And, the gas blast nozzle operates to blow gas into the molten metal as reliably as before.

FIGS. 3(*a*) and 3(*b*) illustrate another embodiment of gas blast nozzle according to the invention. FIG. 3(*a*) is a longitudinal sectional view of the gas blast nozzle, and FIG. 3(*b*) is also a longitudinal sectional view showing how the gas blast nozzle is arranged in the bottom of a furnace.

The gas blast nozzle of FIG. 3(*a*) differs from that of FIG. 1(*a*) in that the refractory block (4) is divided into upper and lower pieces (4*a*), (4*b*). Otherwise, it is the same as its counterpart of FIG. 1(*a*). As described earlier in FIG. 1(*c*), the tubular metal fitting (22) is coupled at its outer end to a gas hose (15) by means of a metal coupler (23) and the annular gap around the small metal pipe (2) is sealed by a rubber stopper (14).

As shown in FIG. 3(*b*), the gas blast nozzle is also fitted to the tuyere-forming bricks (6) at the refractory bottom (11) of the furnace and secured to the outer shell (19) of the furnace by means of a securing ring (21) and a lock member (20). Also, the gap between the nozzle and the tuyere-forming bricks is filled with some castable refractory substance.

FIGS. 4(*a*) and 4(*b*) illustrate a method of using the gas blast nozzle illustrated in FIG. 3(*a*). The worn area (8) in FIG. 4(*a*) is repaired by moving the small metal pipe (2) upwardly in the straight bore (3) until the inner end of the small metal pipe (2) projects over the unworn surface inside the furnace, replacing the damaged upper piece (4*a*) of refractory block with a new upper piece (4*a*) (hereinafter referred to as a repairing brick) as shown in FIG. 4(*b*) and filling the remaining portion with a refractory material (16). Thereafter, the small metal pipe (2) is moved downward until the inner end becomes flush with the upper surface of the repairing brick (4*a*).

With the method of FIGS. 4(*a*) and 4(*b*), the service life of the gas blast nozzle will be further prolonged as compared with repairing the worn area only by filling it with a castable refractory material. Additionally, since the small metal pipe (2) is not projecting into the furnace after the repairing, it will be consumed at a reduced rate.

DESCRIPTION OF THE BEST MODE FOR CARRYING OUT THE INVENTION

Figure 1A:
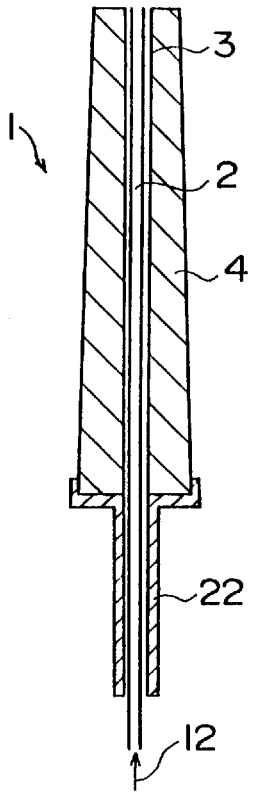
FIGS. 1(*a*), 1(*b*) and 1(*c*) illustrate an embodiment of gas blast nozzle according to the invention.
Figure 1B:
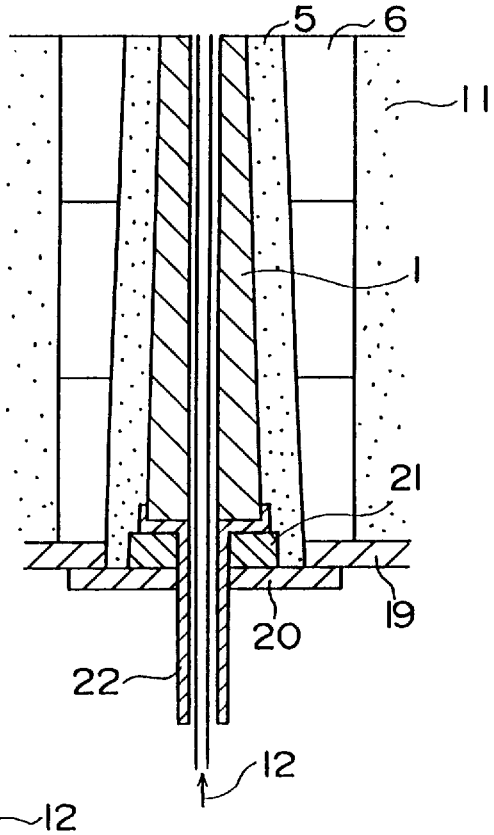
Figure 1C:
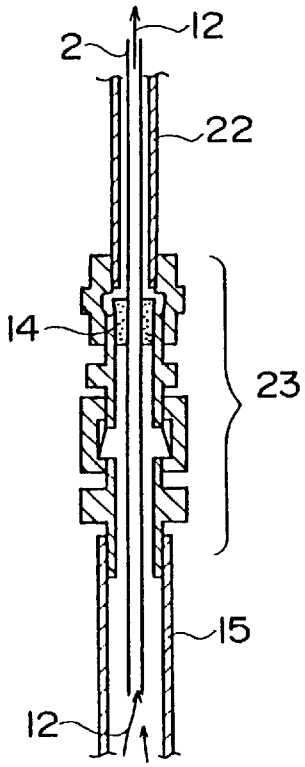
Figure 2A:
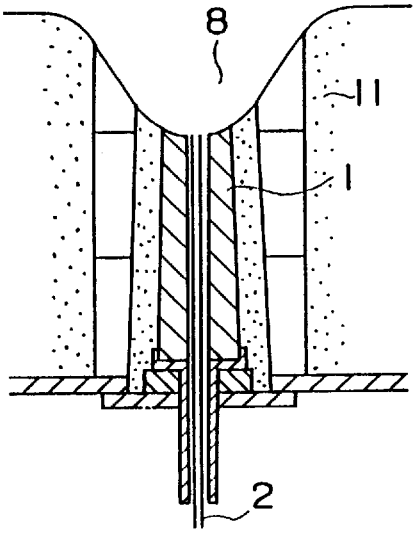
FIGS. 2(*a*), 2(*b*) and 2(*c*) illustrate a method of using the gas blast nozzle of FIGS. 1(*a*)–1(*c*)
Figure 2B:
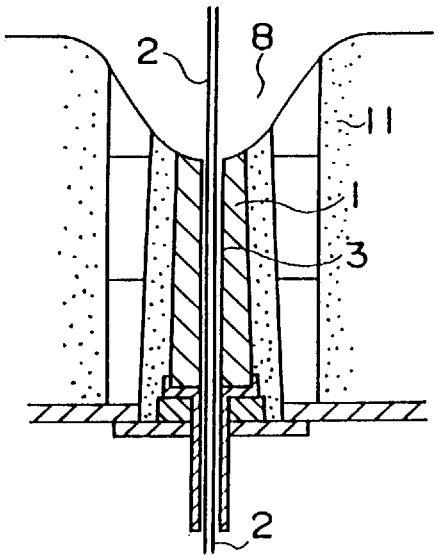
Figure 2C:
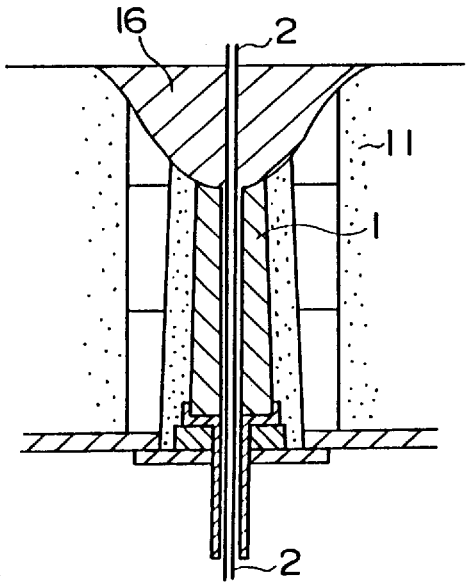

A straight bore having an inner diameter of 5 mm was formed through a refractory block (4) as shown in FIG. 1(*a*) in order to provide a gas blast nozzle for feeding gas from the bottom of an electric furnace. The small metal pipe (2) had an inner diameter of 2 mm, an outer diameter of 4 mm and a length of 2 m and was used with a metal coupler (23) as shown in FIG. 1 (*c*).

Gas was blown into the molten metal in the furnace at a rate of 30 to 100 liter/min. When the gas blast nozzle (1) had been worn by about 200 mm at the inner end, the gas feeding hose (15) as shown in FIG. 1(*c*) was removed, and the small metal pipe (2) was moved upwardly until its upper end was flush with the surface of the repaired refractory bottom (11) of the furnace and the worn area was filled with refractory material. After the repair, the metal pipe (2) was coupled with the gas hose (15) again by means of the metal coupler (23). An ordinary refractory material used for repairing a furnace bottom was used to fill the worn area of the furnace. In order to prevent the inner end of the small metal pipe (2) from being clogged, gas was continually blown through the pipe (2) while the worn area was filled with refractory material.

After four or five repairs, the small metal pipe (2) was replaced by a new one, and the cycle of usual furnace operation and repairing was further repeated. When moving and/or replacing the small metal pipe (2), it was found in some cases that molten metal had entered the annular gap between the straight bore (3) and the small metal pipe (2) and solidified in the gap. However, the small metal pipe (2) could be easily moved by striking it from beneath.

The gas blast nozzle (1) was replaced when the worn area (8) of the nozzle became as deep as 300 mm, and it was found that the gas blast nozzle (1) according to the invention can withstand more than 300 charges, showing a remarkable improvement in the service life when compared with conventional gas blast nozzles that was replaced at every 50 charges.

Figure 3A:
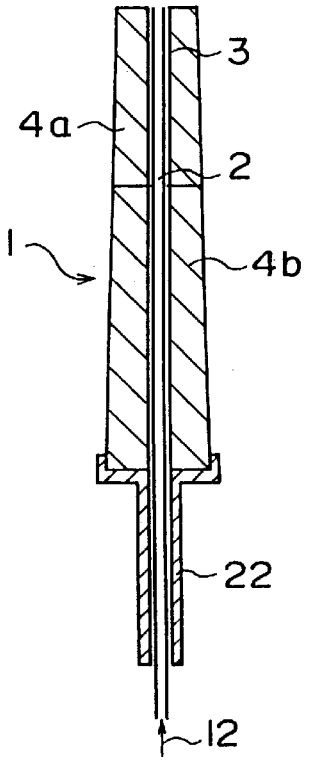
FIGS. 3(*a*) and 3(*b*) illustrate another embodiment of the gas blast nozzle according to the invention.
Figure 3B:
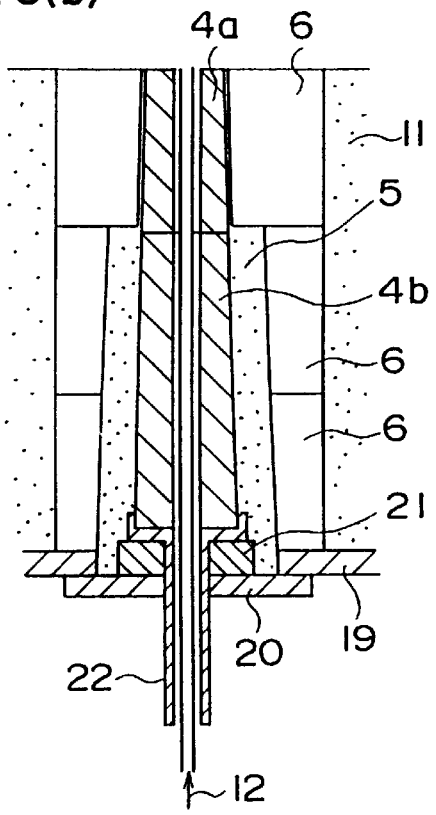
Figure 4A:
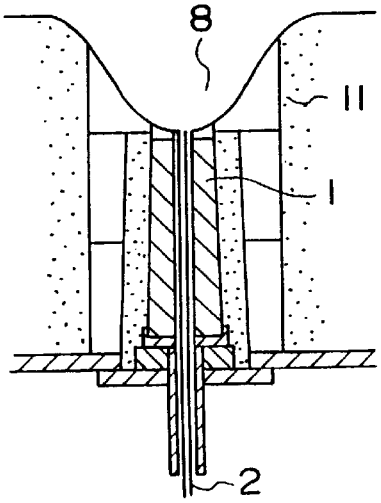
FIGS. 4(*a*) and 4(*b*) illustrate a method of using the gas blast nozzle of FIGS. 3(*a*) and 3(*b*)
Figure 4B:
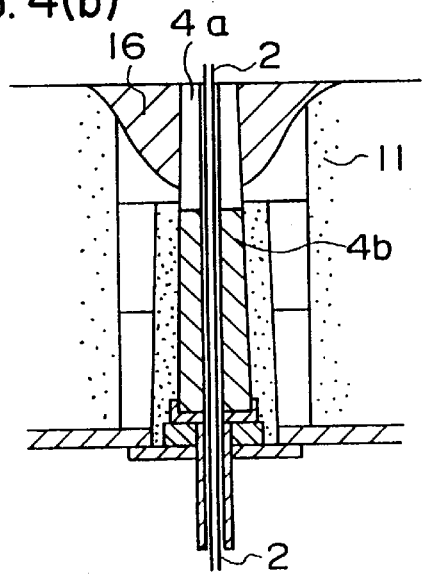
Figure 5A:
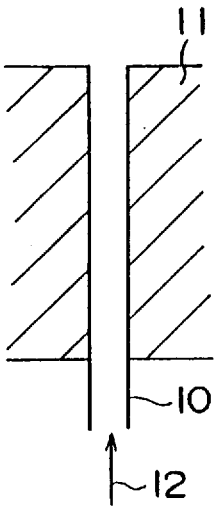
FIGS. 5(*a*), 5(*b*), 5(*c*) and 5(*d*) illustrate a known gas blast nozzle.
Figure 5B:
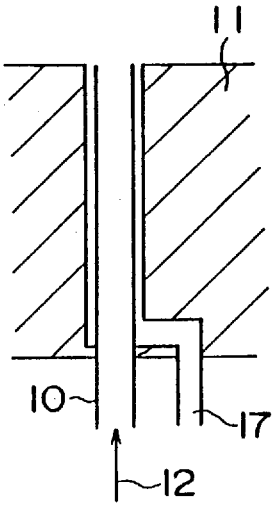
Figure 5C:
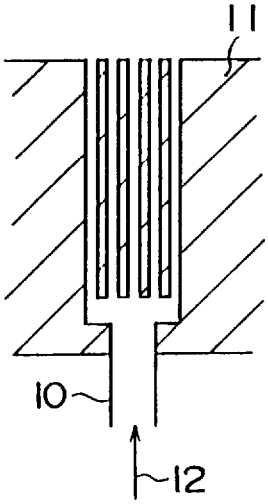
Figure 5D:
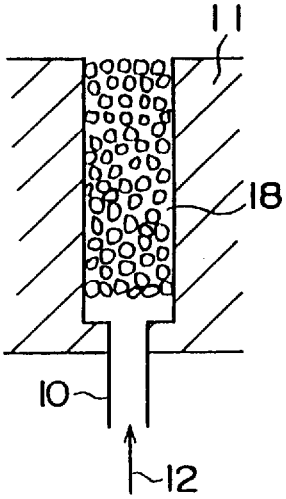
Figure 6A:
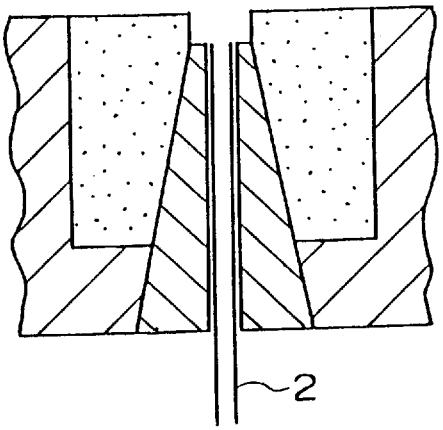
FIGS. 6(*a*) and 6(*b*) illustrate a known gas blast plug.
Figure 6B:
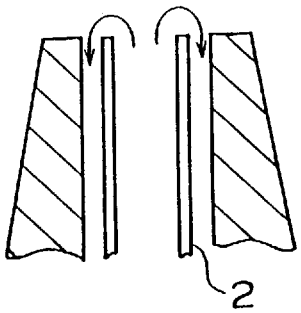

Also, a gas blast nozzle having a split refractory block as shown in FIG. 3 was also tested to see the improvement in the service life. Table 1 shows some of the results of their service life obtained.

TABLE 1

| Case | 1 | 2 |
|---|---|---|
| type of nozzle | two piece type (FIG. 3) | one piece type (FIG. 1) |
| repairing method | using repairing brick (4a) and filling refractory | using only filling refractory |
| service life from replacement to the 1st repair | 170–200 (hrs.) | 170–200 (hrs.) |
| service life from repairing to the next repairing | 170–200 (hrs.) | 80–100 (hrs.) |
| number of repairing from replacement to the next replacement | 5 times | 4 times |
| service life from replacement to the next replacement | 1150 (hrs.) | 550 (hrs.) |

Case 1 in Table 1 represents the use of a split type gas blast nozzle as shown in FIG. 3 which was repaired by using a repairing brick (4*a*) and filling refractory material. After 170 to 200 hours of gas blast operation, the upper piece of refractory block (4*a*) was removed and the small metal pipe (2) was moved upwardly. Thereafter, a new upper piece of refractory block (4*a*) was connected on the lower piece of refractory block (4*b*) with mortar applied therebetween. At the same time, the annular gap between the small metal pipe (2) and the straight bore (3) of the refractory block was also filled with a non-porous refractory material. Next, the worn area was filled with a filling material to complete the first repair. Thereafter, the gas blast nozzle was repaired after every 170–200 operating hours for the second through fifth repairs. The (upper) tuyere-forming brick (6) was also replaced at the even-numbered repairs.

The upper piece of refractory block (4*a*) had an original length of 200 mm, although the remaining length was between 50 and 100 mm at the time of each repair. The nozzle was replaced 170 to 200 hours after the fifth repair. When the nozzle was replaced, it was found that the lower piece of refractory block (4*b*) was undamaged and could be used further.

Case 2 in Table 2 represents the use of a one piece nozzle as shown in FIG. 1, which was repaired only by means of a filling refractory material. After 170 to 200 hours of gas blast operation, the small metal pipe (2) was moved upwardly by a length greater than the height of the worn area of the nozzle and the worn area was filled with a filling refractory material. Then, the gas blast nozzle was repaired after every 80 to 100 operating hours for the second and fourth repairs. After four repairs, it was found that the nozzle had been worn by 250 to 300 mm. Thus, the nozzle was replaced along with the upper tuyere-forming bricks, because they were so damaged that the time required for further repairing seemed to exceed the specified repairing time.

As seen from Table 1, the service life of a repaired nozzle, the number of repairs, and the service life from replacement to the next replacement had been increased in Case 1.

The gas blast nozzle according to the invention can reduce the frequency of replacement of the gas blast nozzle and can reduce the down time of the furnace operation. Additionally, it reduces the work load of the replacing operation under adverse working conditions and is free from the problem of gas leaking through the gas blast nozzle. Finally, it can be applied at reduced cost because it is structurally simple.

I claim:

1. A gas blast nozzle for a steel making furnace comprising:

a block of refractory material having a bore extending therethrough, said block being disposed in a wall of the furnace so that said bore extends from outside the furnace to inside the furnace;

a fitting having a tubular portion, a radially-extending portion at one end of said tubular portion, and a bore extending through said tubular and radially-extending portions, said block of refractory material being coupled to said fitting at said radially extending portion thereof to form an airtight connection between said block and said radially-extending portion, said bore of said block being aligned with said bore of said fitting;

a metal pipe disposed within the bores of said block and said fitting;

a coupler for coupling said fitting with an external gas source hose, said coupler having a through hole aligned with the bores of said block and said fitting, said metal pipe extending into said through hole so as to be in fluid communication with the hose coupled to said fitting; and a rubber stopper disposed within said coupler and having a hole formed therethrough through which said metal pipe extends, said rubber stopper being in snug contact with an inner surface of said through hole of said coupler and an outer surface of said metal pipe to form a generally air-tight seal between the inner surface of said through hole and the outer surface of said metal pipe, so that gas communicated to said nozzle by said hose is transmitted into the furnace through said metal pipe.

2. The nozzle of claim 1 wherein said block of refractory material is disposed in a bottom wall of the furnace.

3. The nozzle of claim 1 wherein said fitting is made of metal.

4. The nozzle of claim 1 wherein said coupler is made of metal.

5. The nozzle of claim 1 wherein said metal pipe is slidable through the hole formed through said rubber stopper.

6. The nozzle of claim 1 wherein said metal pipe extends at least from an inner surface of the wall of the furnace to a point outside the furnace beyond an end of said fitting opposite said radially extending portion.

7. The nozzle of claim 6 wherein said metal pipe has a length of at least two meters.

8. The nozzle of claim 1 wherein said block of refractory material includes an annular gap defined between the outer surface of said metal pipe and an inner surface of the bore extending through said block of refractory material.

9. The nozzle of claim 1 wherein said block of refractory material comprises two pieces of refractory material arranged end-to-end, said bore extending through both of said two pieces.

10. A method of repairing a worn area of a steel making furnace, the worn area including a portion of a gas blast nozzle and a portion of a wall of the furnace surrounding the gas blast nozzle, the gas blast nozzle including a block of refractory material having a bore extending therethrough, the block being disposed in the wall of the furnace so that the bore extends from outside the furnace to inside the furnace; a fitting having a tubular portion, a radially-extending portion at one end of the tubular portion, and a bore extending through the tubular and radially-extending portions, the block of refractory material being coupled to the fitting at the radially extending portion thereof to form an airtight connection between the block and the radially-extending portion, the bore of the block being aligned with the bore of the fitting; a metal pipe disposed within the bores of the block and the fitting; a coupler for coupling the fitting with an external gas source hose, the coupler having a through hole aligned with the bores of the block and the fitting, the metal pipe extending into the through hole so as to be in fluid communication with the hose coupled to the fitting; and a rubber stopper disposed within the coupler and having a hole formed therethrough through which the metal pipe slidably extends, the rubber stopper being in snug contact with an inner surface of the through hole of the coupler and an outer surface of the metal pipe to form a generally air-tight seal between the inner surface of the through hole and the outer surface of the metal pipe, so that gas communicated to the nozzle by the hose is transmitted into the furnace through the metal pipe, the method comprising:

moving the metal pipe through the rubber stopper and the bores of the fitting and the block toward the inside of the furnace until an inner end of the metal pipe extends beyond an unworn surface of the furnace wall surrounding the worn area; and filling the worn area with refractory material to a level so as to be generally flush with the unworn surface of the furnace wall surrounding the worn area.

11. The method of claim 10, the worn area including a portion of the bottom wall of the furnace and the block of refractory material being disposed in the bottom wall of the furnace.

12. A method of repairing a worn area of a steel making furnace, the worn area including a portion of a gas blast nozzle and a portion of a wall of the furnace surrounding the gas blast nozzle, the gas blast nozzle including a block of refractory material comprising first and second pieces of refractory material arranged end-to-end and having a bore extending through the two pieces, the block being disposed in the wall of the furnace so that the bore extends from outside the furnace to inside the furnace; a fitting having a tubular portion, a radially-extending portion at one end of the tubular portion, and a bore extending through the tubular and radially-extending portions, the first piece of refractory material of the block of refractory material being coupled to the fitting at the radially extending portion thereof to form an airtight connection between the first piece and the radially-extending portion, the bore of the block being aligned with the bore of the fitting; a metal pipe disposed within the bores of the block and the fitting; a coupler for coupling the fitting with an external gas source hose, the coupler having a through hole aligned with the bores of the block and the fitting, the metal pipe extending into the through hole so as to be in fluid communication with the hose coupled to the fitting; and a rubber stopper disposed within the coupler and having a hole formed therethrough through which the metal pipe slidably extends, the rubber stopper being in snug contact with an inner surface of the through hole of the coupler and an outer surface of the metal pipe to form a generally air-tight seal between the inner surface of the through hole and the outer surface of the metal pipe, so that gas communicated to the nozzle by the hose is transmitted into the furnace through the metal pipe, the method comprising:

moving the metal pipe through the rubber stopper and the bores of the fitting and the block toward the inside of the furnace until an inner end of the metal pipe extends beyond an unworn surface of the furnace wall surrounding the worn area;

replacing the second piece of refractory material with a new second piece of refractory material to repair a portion of the worn area; and filling a remaining portion of the worn area with refractory material to a level so as to be generally flush with the unworn surface of the furnace wall surrounding the worn area.

13. The method of claim 12, the worn area including a portion of the bottom wall of the furnace and the block of refractory material being disposed in the bottom wall of the furnace.

* * * * *

UNITED STATES PATENT AND TRADEMARK OFFICE

CERTIFICATE OF CORRECTION

PATENT NO. : 5,863,490

DATED : January 26, 1999

INVENTOR(S) : YAMADA

It is certified that error appears in the above-identified patent and that said Letters Patent is hereby corrected as shown below:

On the Cover Page:

Please add:

- - Related U.S. Application Data

[63] Continuation of international application number PCT/JP96/01356 May 23, 1996 - -

Signed and Sealed this

Nineteenth Day of September, 2000

*Attest:*

Q. TODD DICKINSON

*Attesting Officer*

*Director of Patents and Trademarks*